United States Patent [19]

Ritter et al.

[11] 4,096,680

[45] Jun. 27, 1978

[54] REINFORCEMENT GRID FOR STEEL CONCRETE CONSTRUCTION

[75] Inventors: Klaus Ritter; Gerhard Ritter; Josef Ritter, all of Graz, Austria

[73] Assignee: Firma AVI Alpenlandische Veredelungs- Industrie Gesellschaft mbH., Graz, Austria

[21] Appl. No.: 795,040

[22] Filed: May 9, 1977

[30] Foreign Application Priority Data

May 7, 1976 Austria ..... 3378/76

[51] Int. Cl.[2] ..... E04C 2/42

[52] U.S. Cl. ..... 52/665; 52/719

[58] Field of Search ..... 52/665, 719, 686, 600; 403/400

[56] References Cited

U.S. PATENT DOCUMENTS

| | | | |
|---|---|---|---|
| 1,512,763 | 10/1924 | Holmgreen | 52/719 X |
| 3,200,488 | 8/1965 | Johansson | 403/400 X |

FOREIGN PATENT DOCUMENTS

| | | | |
|---|---|---|---|
| 1,138,801 | 6/1957 | France | 52/719 |
| 947,875 | 7/1949 | France | 52/600 |

*Primary Examiner*—Ernest R. Purser
*Assistant Examiner*—Carl D. Friedman
*Attorney, Agent, or Firm*—Ernest F. Marmorek

[57] ABSTRACT

The invention relates to reinforcement grids for steel concrete construction and consisting of longitudinal transverse rods crossing one another which, at some or all of their crossing points, are connected by pieces of binding wire looped around the rods and closed by twisting their free ends together. In order to give the grid rectangular stability, within each mesh of the grid, or within each rectangular mesh group comprising a number of adjacent meshes, the binding wire loops at the four crossing points of the rods defining the mesh or mesh group are looped around the rods defining the mesh or mesh group are looped around the rods so that the planes of half the loops are 90° from the planes of the remaining loops, and the loops in each direction are uniformly present in the grid.

7 Claims, 6 Drawing Figures

REINFORCEMENT GRID FOR STEEL CONCRETE CONSTRUCTION

The invention relates to reinforcement grids for steel concrete construction which consist essentially of longitudinal and transverse rods crossing one another and which at certain of their crossing points are tied together by loops of binding wire closed loops by twisting the free ends of the pieces together.

Grids of this kind have been known from the beginnings of steel concrete construction, when reinforcements for load bearing slabs used to be produced by hand by the described connection of the rods forming the reinforcement. In that case pieces of binding wire bent into a U were put around some or all of the crossing points of cross of the reinforcement bars, so that the plane of each U-shaped piece of binding wire inclined at an angle of approximately 45° to the axes of the two rods to be connected, and the ends of the pieces of binding wire extended above the two reinforcement rods and were connected together by twisting by means of simple tools, whereby the binding wires now forming loops were brought firmly into contact with the two reinforcing rods thus connected.

In spite of the advantages of the electro-welding technique which has in the meanwhile been highly developed for the production of reinforcement grids, it is, under certain circumstances, advantageous or even necessary to resort again to the binding technique. This is so in the case in which the grid rods are of self-hardening alloy steel which, by electrical resistence welding, can be connected together only with difficulty and with heavy outlay of power. This is particularly the case when the rods are hot rolled rods such as ribbed rods, which have a coating of scale. Since, with binding in contrast to welding, impairment of the quality of the steel is avoided, bound reinforcement grids may be employed also for cases of dynamic loading.

Application of the binding technique, especially in the production of so-called stock mats which are prepared in case of need and have to be stacked and transported, has hitherto been opposed to a considerable extent by the relatively poor stability of the shape of the grid sheets of grid mats thereby obtained, in the face of forces acting in the plane of the mat.

The object of the invention is to improve the stability of shape (that is, the rectangular stability) of reinforcement grids produced by the application of the binding technique, and takes account of the fact that two rods crossing one another at right angles and connected at a crossing point by binding wire in the way described, can, without significant resistence, be brought by relative swivelling into a position parallel to one another if swivelling is effected in such a direction that the angle included between each of the two rods and the loop of binding wire surrounding them increases. In the case of swivelling motion in the opposite sense the binding wire is, on the contrary, drawn tighter and thereby opposes the swivelling of the two rods with a significant resistence.

Hitherto in the application of the binding technique to the production of reinforcement grids, the positions of the planes of the binding wire loops with respect to the axes of the two rods being connected was chosen completely arbitrarily and therefore only relatively poor stability of shape, subject to wide fluctuations, could be achieved for the grid.

In accordance with the invention, in a reinforcement grid of the kind described, each mesh of the grid or rectangular mesh group comprising a number of adjacent meshes, the binding wire loops at the four crossing points of the rods defining the mesh or mesh groups respectively are looped around the rods at their crossing points in planes which are inclined to the longitudinal rods in pairs in opposite directions.

In this way as many binding wire loops oppose swivelling of all the transverse rods with respect to the longitudinal rods in one direction of rotation as in the other, out of the rectangular shape of the meshes into a parallelogram or rhomboidal shape, so that the grid with a given number of binding wire loops has the greatest possible stability of shape.

The grids of the present invention thus consist essentially of longitudinal and transverse rods crossing one another at right angles, said transverse and longitudinal rods being tied together at a sufficient number of their crossing points to provide said grid with rectangular stability, each of said tieings being by means of a loop formed by twisting the ends of a piece of wire together, the planes of half of the loops thus formed being 90° away from the planes of the remaining loops, the loops in said former planes and the loops in said latter planes being uniformly distributed throughout said grid.

Tieing of the binding wires has hitherto always been effected in such a way that the twists formed by the twisting of the two ends of the binding wires stood up at right angle to the planes defining the two sides or faces of the reinforcement grid. The consequence was that the twists stood out above one or both of the two planes tangential to the rods of the grid, so that the grids so formed, when to save space they were stored on top of one another, could only be separated from one another again with difficulty, because of interlocking of said twists.

This disadvantage is avoided if, at each crossing point where the rods are tied together by binding wire, the line joining the point of contact between the crossed rods to the root of the twist includes an acute angle with the common plane of contact between the families of crossed rods, which preferably amounts to substantially 45°. In other words, the plane of each alternate loop on each transverse rod is 90° from the plane of each of the remaining loops on said transverse rod.

Such a position for the root of the twist allows the twist to bend round so that it comes to lie next to the rod against which its root is resting. The twist thus lies within the planes which define the surfaces or faces of the grid. The twist then does not stand up above one of the two opposite planes tangential to the families of crossed rods that is, it does not rise above the planes which define the surface of the grid, so that a number of grids produced in this way may be stacked on top of one another without danger of the catching of one grid with another. A reinforcement grid of this form is therefore characterised by the feature that the twists as a whole lie between the opposite planes tangential to the families of crossed rods that is, as stated, they lie within the planes which define or bound the surfaces or faces of the grid. In other words, the plane of each alternate loop on each vertical rod is parallel to the plane of each of the remaining loops on said transverse rod.

For special purposes it may on the other hand sometimes be advantageous to position the twists in such a way that they may act as spacers for the reinforcement grids. Such a reinforcement grid is characterised in that at each crossing point where the rods are tied together the root of the twist with respect to one of the two cross rods lies diametrically opposite to the point of contact between the two crossed rods, and that the twist is positioned as a spacer directed normally to the common plane of contact between the families of crossed rods so that the twist extends upwardly or downwardly at right angles to the plane on which the longitudinal transverse rods meet each other.

Examples of grids constructed in accordance with the invention are illustrated in the drawings, in which.

Figure 2:
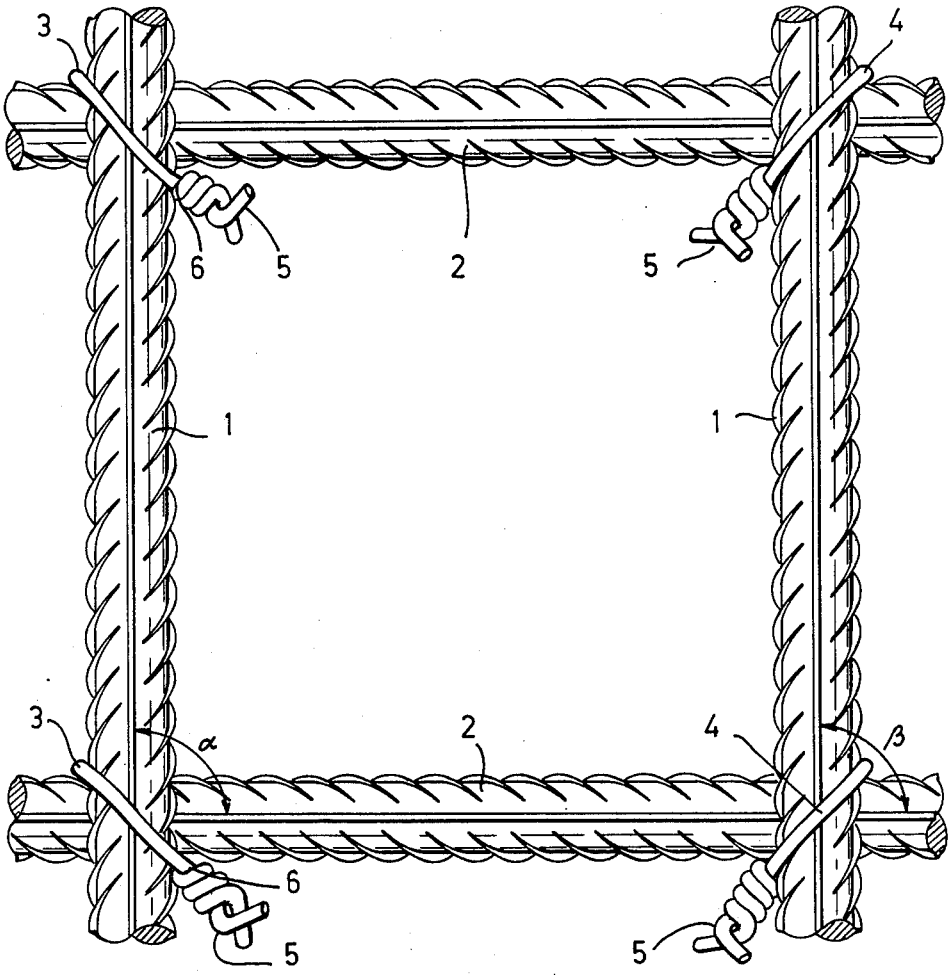
FIG. 2 shows the mesh of FIG. 1 in plan.

In all of the figures the longitudinal rods of the reinforcement grid are designated by the numeral 1, and the transverse rods by 2. The diameters of the longitudinal and transverse rods may be in any ratio to one another corresponding with engineering requirements. In the figures, merely for example, the diameters of the longitudinal and transverse rods are shown equal. Binding wire loops 3 and 4 are formed by twisting the ends of the wires to form twist 5, and connect the longitudinal and transverse rods at some or all of the crossing points. Binding wire loops are designated by 3. In FIG. 2 the planes of these loops are vertical to the plane of the grid; the planes of the loops 3 run from top left to bottom right, whereas the planes of the binding wire loops designated by 4 run from bottom left to top right of the drawing.

From FIG. 2 it may easily be seen that loops 3 oppose considerable resistance to an increase in the angle $\alpha$ between the longitudinal and transverse rods of the grid, while the loops 4 oppose a reduction but not an increase in the angle $\beta$ so that the desired stability of shape of the grid mat is achieved by the uniform distribution of loops of both kinds.

Figure 1:
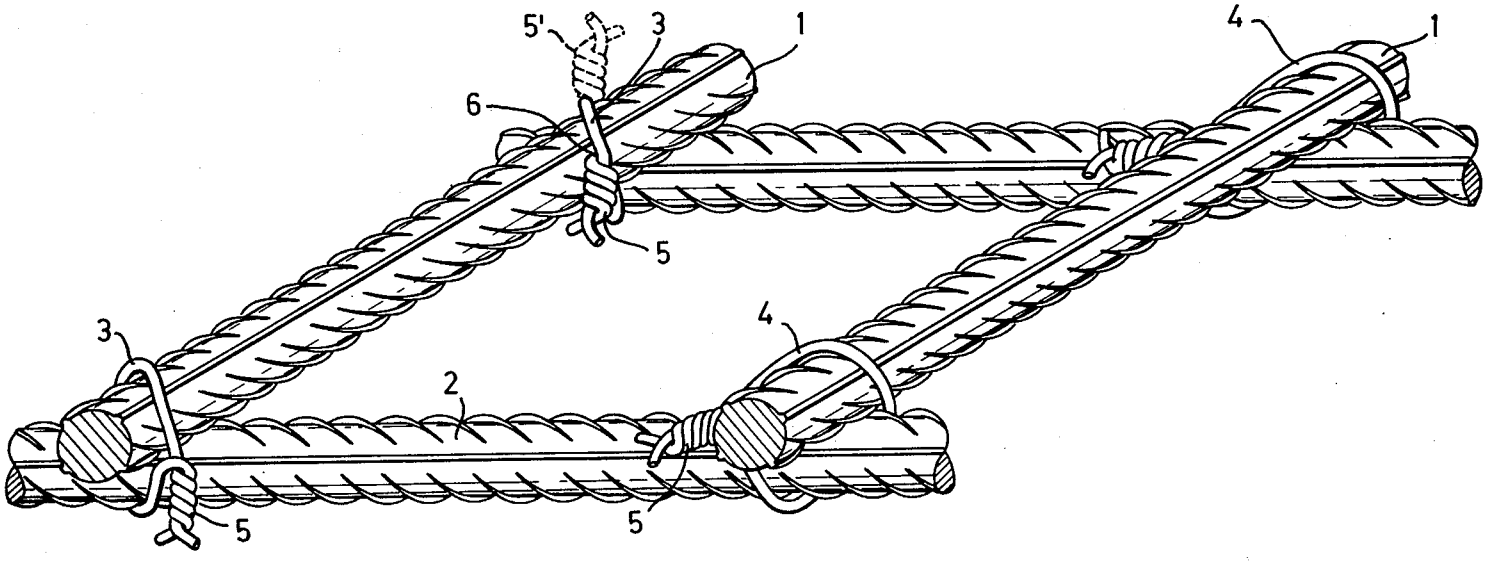
FIG. 1 is an exonometric view of one grid mesh.

As may be understood particularly from FIGS. 1 and 2, the roots 6 of the twists 5 lie at the side next to the longitudinal rods 1, so that the line joining the point of contact between the crossed rods 1 and 2 to the root of the twist 5 includes an acute angle with the plane of contact common to the families of crossed rods. The twists 5 lie beside rods 1 within the plane which bound the surfaces of the grid and are thus arranged in such a way that they do not stand up above one of the two opposite external planes tangential to the two families of crossed rods i.e., they do not rise above either of center planes.

Figure 3:
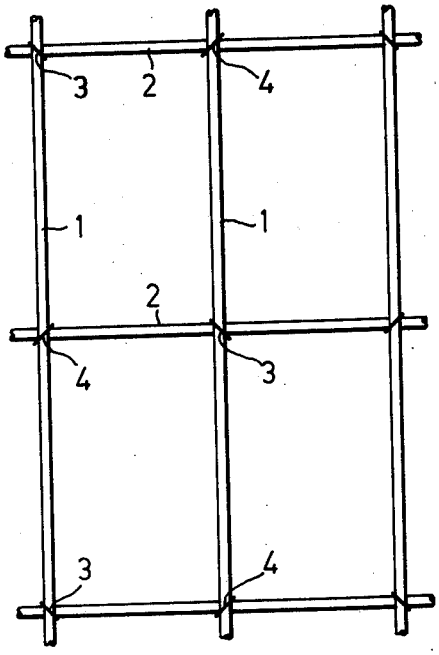
FIGS. 3 to 6 show in plan different arrangements of binding wire loops at crossing points of the rods of reinforcement grids.

In FIG. 3 the arrangement of the pieces of binding wire is such that binding wire loops 3 and 4 alternate with one another along each longitudinal and transverse rod. Hence each mesh of the grid is bounded at its four corners by two loops 3 the planes of which are parallel with one diagonal of the mesh and by two loops 4 planes of which are parallel with the other diagonal of the mesh.

Figure 4:
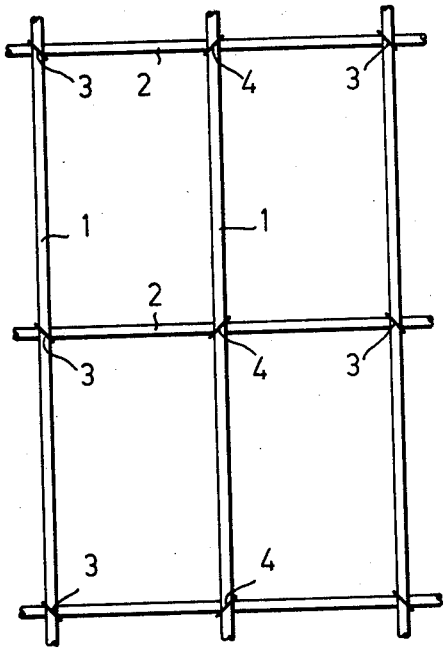

In the example shown in FIG. 4, the binding wire loops are arranged along the rods in such a way that the planes of the loops along each longitudinal rod are parallel. Thus along each longitudinal rod only loops 3 or only loops 4 are present. Thus at the four corners of each mesh the binding loops are so distributed that one loop 3 and one loop 4 lie at opposite corners of the mesh.

Figure 5:
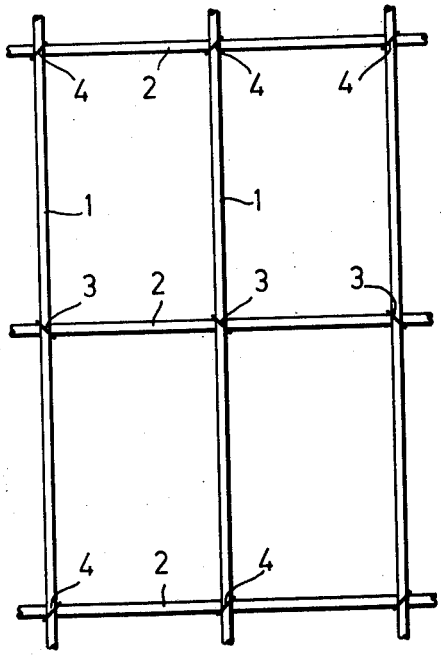

In FIG. 5 two loops 3 and two loops 4 lie at opposite corners of the mesh, but the arrangement in this case is such that loops 3 and 4 are respectively present on alternate transverse rods, in other words, the plane of each alternate loop on each vertical rod is parallel to the plane of each of the remaining loops on said transverse rod.

Figure 6:
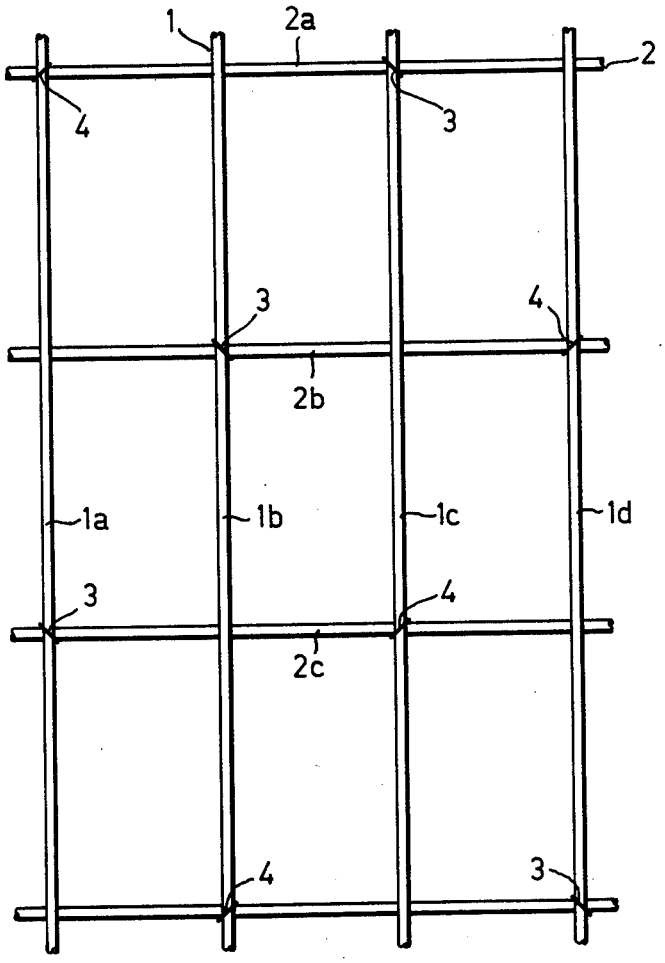

FIG. 6 illustrates a grid in which only every alternate crossing point is tied with a loop of binding wire. For clearer distinction the longitudinal rods are designated by *1a*, *1b*, *1c* and *1d* and the transverse rods are designated by *2a*, *2b*, and *2c*. The figure shows a mesh group which the corners which are tied by loops of binding wire the corners are formed by the intersections of longitudinal rods *1a* and *1c* with transverse rods *2a* and *2c*.

In FIG. 6, loops of binding wire looped around the rods of the grid in respectively parallel planes are distributed at the four corners of the mesh group in such a way that the planes of the binding wire loops which lie at the opposite corners of the mesh group are parallel. Thus the planes of loops 3 are parallel to each other, as are the planes of loops 4, and only each alternate crossing point of the transverse and longitudinal rods is tied.

FIG. 6 based on one mesh group therefore finds correspondence with FIG. 3 based on one mesh. Other mesh groups may likewise be built up to correspond with the mesh groups of FIGS. 4 and 5 as well.

In FIG. 1 twist 5′ (shown in dotted lines) is made by rotating loop 3 so that twist 5 rises vertically from the upper plane of the grid and acts as a spacer. These spacers 5′ when turned downwards hold the reinforcement grid at a clearance from any supports present.

In the claims, the terms "transverse" and "longitudinal" are used for convenience to designate the two sets of parallel rods of which the grids are composed. In each grid, one set of rods is superimposed over the other, and each set lies at an angle of 90° from each other. When any grid is rotated 90° in its plane, the transverse rods become the longitudinal rods and the longitudinal rods become the transverse rods.

We claim:

1. A reinforcement grid for steel concrete construction, consisting essentially of longitudinal and transverse rods crossing one another at right angles, said transverse and longitudinal rods being tied together at a sufficient number of their crossing points to provide said grid with rectangular stability, each of said tieings being by means of a loop formed by twisting the ends of a piece of wire together, the planes of half of the loops thus formed being 90° away from the planes of the remaining loops, the loops in the said former planes and the loops in said latter planes being uniformly distributed in said grid.

2. A grid according to claim 1, wherein substantially all of said twists lie between the external planes which bound the surface of said grid.

3. A grid according to claim 1, wherein the twists composed of the twisted ends of said wires extend 90° upward from one of the external planes of said grid.

4. A grid according to claim 1, wherein the plane of each alternate loop on each transverse rod is 90° from the plane of each of its remaining loops on said transverse rod.

5. A grid according to claim 4, wherein the plane of each alternate loop on each longitudinal rod is parallel to the plane of each of the remaining loops on said longitudinal rod.

6. A grid according to claim 1, wherein the planes of the loop on each transverse rod are parallel to each other, and the plane of each alternate loop on each longitudinal rod is 90° from the plane of each of the remaining loops on said longitudinal rod.

7. A grid according to claim 1, wherein the transverse and longitudinal rods are tied together only at each alternate crossing point.

* * * * *